US008896459B2

(12) United States Patent
Denison et al.

(10) Patent No.: US 8,896,459 B2
(45) Date of Patent: Nov. 25, 2014

(54) MOTION ACTIVATED SOUND PRODUCING BOTTLE TOP

(76) Inventors: Camilla Marie Denison, Lake Orion, MI (US); Buford Harrison Shumaker, Fenton, MI (US)

( * ) Notice: Subject to any disclaimer, the term of this patent is extended or adjusted under 35 U.S.C. 154(b) by 284 days.

(21) Appl. No.: 13/210,505

(22) Filed: Aug. 16, 2011

(65) Prior Publication Data

US 2013/0043205 A1 Feb. 21, 2013

(51) Int. Cl.
*G08B 3/00* (2006.01)
*B65D 51/24* (2006.01)

(52) U.S. Cl.
CPC ..... *B65D 51/24* (2013.01)
USPC ..... 340/691.1; 340/692; 340/384.1; 340/500; 340/540

(58) Field of Classification Search
None
See application file for complete search history.

(56) References Cited

U.S. PATENT DOCUMENTS 5,637,928 A * 6/1997 Nakajima et al. ..... 307/10.2
6,771,165 B2 * 8/2004 Burg II et al. ..... 340/384.1
7,336,194 B2 * 2/2008 Hillman et al. ..... 340/686.1

FOREIGN PATENT DOCUMENTS

JP 2001-119775 * 4/2001 ..... H04R 1/06

* cited by examiner

*Primary Examiner* — Mohammad Ghayour
*Assistant Examiner* — Brian Wilson
(74) *Attorney, Agent, or Firm* — Brooks Kushman P.C.

(57) ABSTRACT

An apparatus includes an interior component, movably attached to an exterior component. Rotation of the exterior component causes an actuation piece to activate a circuit provided to either the interior or exterior component. Activation of the circuit causes sound to be played from a speaker provided to either the interior or exterior component. Also included is a hollow portion provided to the interior component, of sufficient diameter to fit a bottle top therein. Also, the apparatus includes a grip, provided on the hollow portion and operable to fixedly engage the bottle top at least when the exterior component is rotated. Rotation of the exterior component relative to the interior component causes engagement of the interior component by the exterior component, such that the interior component is caused to rotate in concert with the exterior component, further causing rotation of the bottle top which the grip fixedly engages.

8 Claims, 3 Drawing Sheets

MOTION ACTIVATED SOUND PRODUCING BOTTLE TOP

TECHNICAL FIELD

The illustrative embodiments generally relate to a motion activated sound producing bottle top.

BACKGROUND

Novelty items have always been a popular aspect of society. Entire businesses have sprung up focused solely on the sale of attention grabbing items, provided for peoples' amusement and enjoyment.

One common aspect of many novelty items is the integration of music or sound into the item. From dancing flowers to sound playing bottle openers that actuate upon contact with a bottle top, people seem to like the integration of sound with common products.

Sound producing chips have even begun to work their way into more commonplace items. Items can play a pre-recorded or customized message, and many other "commonplace" items have sound chips included therein to provide entertainment or notification of use. Additionally, sound actuation has a great deal of use in marketing, adding that extra "pop" that draws the attention of bystanders or shoppers.

Even with all this sound-integration, however, there are plenty of everyday items that have not yet had entertaining sound producing features added thereto. Many times, there has simply been a lack of development, or a lack of a proper format for integration of sound into the item. The illustrative embodiments deal with one such case.

SUMMARY

In a first illustrative embodiment, an apparatus includes an interior component, movably attached to an exterior component. Rotation of the exterior component causes an actuation piece to activate a circuit provided to either the interior or exterior component. Activation of the circuit causes sound to be played from a speaker provided to either the interior or exterior component.

The illustrative embodiment also includes a hollow portion provided to the interior component, of sufficient diameter to fit a bottle top therein. Also, the example includes a grip, provided on the hollow portion and operable to fixedly engage the bottle top at least when the exterior component is rotated. Rotation of the exterior component relative to the interior component causes engagement of the interior component by the exterior component, such that the interior component is caused to rotate in concert with the exterior component, further causing rotation of the bottle top which the grip fixedly engages.

In a second illustrative example, an apparatus includes an outer shell, having a cylindrical hollow interior and an inner shell, having a cylindrical exterior smaller than the hollow interior of the outer shell and a hollow interior of sufficient size to fit over a bottle top. The inner shell is movably attached to the cylindrical, hollow interior of the outer shell. Rotation of the outer shell causes the outer shell to rotate with respect to the inner shell for at least some period of time before an engagement portion of the outer shell engages the inner shell. Upon engagement of the inner shell, the inner shell is caused to rotate in concert with the outer shell.

The second embodiment also includes a grip, affixed to the hollow interior of the inner shell, sufficient to resiliently engage a bottle top such that the bottle top rotates when the inner shell rotates. This embodiment further includes an actuator, fixedly attached to at least one of the inner or outer shell. Movement of the outer shell relative to the inner shell causes the actuator to activate a circuit on a printed circuit board, provided between the hollow interior of the inner shell and an exterior of the outer shell.

Also, this embodiment includes a resilient, flexible spring, engaged by both the inner and outer shell. Movement of the outer shell relative to the inner shell causes the spring to deform, storing energy. The energy is sufficient to cause rotation of the inner shell relative to the outer shell, moving the actuator out of a position to activate the circuit, once the bottle top has been removed from a bottle and the energy is released. The embodiment further includes a speaker, connected to the printed circuit board and operable to play sound when the circuit is activated by movement of the actuator.

In a third illustrative embodiment, an apparatus includes an inner shell movably attached to an outer shell. Rotation of the outer shell causes the outer shell to move relative to the inner shell until an engagement portion of the outer shell engages the inner shell. The inner shell is caused to move in concert with the outer shell once the engagement portion engages the inner shell.

This embodiment also includes an actuator, provided between the inner and outer shells. Movement of the outer shell relative to the inner shell causes the actuator to activate a circuit upon sufficient movement of the outer shell. The embodiment additionally includes a speaker, provided between the inner and outer shells, wherein activation of the circuit causes the speaker to output sound.

DETAILED DESCRIPTION

Figure 1:
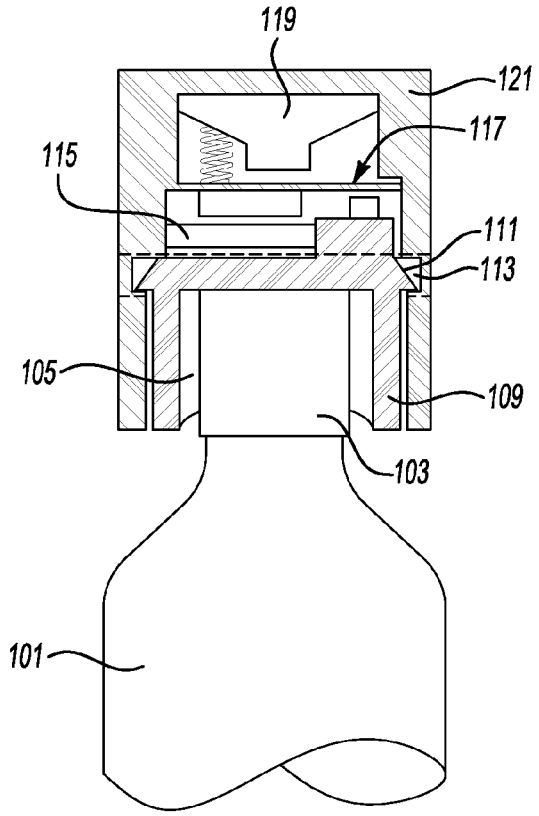
FIG. 1 is a section view of an illustrative example of a sound producing bottle cap accessory.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Although many products have had sound integrated components added thereto, there remains a vast array of expandability of the concept of sound integration. One place where sound may be particularly enjoyable is in the integration with the opening of a bottle.

Whether it is a soft drink, water product, or liquor company, drink advertisers spend hundreds of millions of dollars a year on advertising and product packaging. New packaging can draw the eye, make a product more exciting, and generally lure a consumer away from a competitor.

One example of this can be seen with several popular liquor bottles, now shaped like certain objects. The shape of the bottle alone may be enough to encourage someone to purchase the product, even if they're not sure of the contents.

The same holds true for labeling and packaging. Designed to draw the eye and evoke a certain emotion within the viewer, attempts are made to keep packaging fresh and new, and a game of one-upmanship is constantly ongoing. Sometimes, packaging will even include secondary goods, such as themed tumbles included with the packaging for a liquor product around holidays or as special promotions.

A huge market also exists for novelty goods related to drink oriented products. Custom glasses of varying shapes and colors, shaped ice cubes, glass identifiers, etc.—whatever the goods, when a planning a party it seems that people will go to great lengths to ensure that there is a new twist involved, that themes are maintained, and that a party atmosphere is generally present.

The illustrative embodiments presented herein deal generally with bottle top accessories (BTA) that produce a sound at least upon the opening of a bottle. In one embodiment, the accessory is designed so as to be placeable over an existing bottle top and to secure thereto. In other embodiments, the accessory may have the bottle top integrated into the design. In still another embodiment, the bottle top accessory may have the capability to grip a bottle top but also be removable. In this embodiment, the accessory may be useful for opening stuck bottles, while at the same time providing an entertaining experience.

Integrated into the bottle top accessory is a sound producing chip, which can be activated upon the opening of the bottle. For example, upon the opening of a bottle of Tequila with a bottle top accessory applied thereto, the bottle top accessory could play the song "Tequila" or some other theme-appropriate music. A different bottle top accessory may play the song "Yo Ho Ho" when opening a bottle of rum using the accessory.

Certain celebrities and musicians also have affiliated themselves with brands of drinks (both alcoholic and non-alcoholic), and they may wish to have their voices or music played whenever their bottles are opened. Other people may collect various versions of the bottle top accessory to use repeatedly for novelty purposes when having a party. Advertisers may wish to sell the accessory in conjunction with a product to promote sales and to give the customer a unique experience.

One particular version of the bottle top accessory is described herein in some detail, but this description is intended for illustrative purposes only and is not intended to limit the scope of the invention thereto. As will be appreciated, numerous forms of actuation of the chip upon opening the bottle are possible. Other examples are given, although they too are provided for illustrative purposes only and are not intended to limit the scope of the invention.

FIG. 1 shows an illustrative example of a sound producing bottle top accessory. In this illustrative, non-limiting example, the accessory has been removably affixed to the cap 103 of a long-necked bottle 101. A long-neck is not a necessity for affixation of the bottle top accessory, any top or cap can have the accessory affixed thereto, the opening which slides over the cap (discussed later in some detail), could simply be tailored to fit the particular cap/top to which it is intended to be affixed. In at least one illustrative embodiment, the BTA itself is the top of the bottle, and has one or more spiraled ribs provided thereto for affixation around a receiving bottle-neck.

In this particular example, the BTA is affixed to the top of the bottle by a series of crush-ribs 105. These crush-ribs are flexible, gripping ribs provided on the inside of a sleeve element 109 of the BTA, and conform to the shape of the bottle top 103, while providing a resilient, oppositional force to an exterior shell of the bottle top, sufficient to hold the BTA in place.

For a particular bottle top, the ribs should grasp the top firmly enough that the BTA cannot freely rotate all the way around the top without some mechanism in place for opening the bottle. In this example, friction and pressure provided by the ribs are sufficient to grip the bottle top 103 such that when the BTA is twisted, the bottle top is similarly turned and the bottle is opened.

A cover element 121, in this example, can rotate to a certain degree oppositional to a fixed sleeve element 109. In this example, the sleeve element 109 contains the crush ribs 105 and is held to the bottle top 103. The sleeve element 109 remains relatively stationary as the cover 121 rotates to the desired degree, until an engaging mechanism provided in drive slot 113 of the cover 121 engages a drive tab 111 of the sleeve element 109. Once the engaging mechanism has engaged the drive tab 111, the sleeve element 109 is rotated in the same direction as the cover 121. This subsequent rotation is the rotation used to remove the top 103 from the bottle 101.

Prior to the engaging of the drive tab 111, the cover's 121 free rotation causes the flexing of a leaf spring 115 which moves an actuator into place to close a circuit, causing audio playback. In this example, the leaf spring 115 is engaged by both the cover 121 and the sleeve 109, and rotation of the cover 121 flexes the leaf spring 115 due to the movement of the engagement point on the cover 121 and the fixed nature of the spring with respect to the sleeve 109. The leaf spring 115 should be flexible enough that it will flex before providing sufficient force to the sleeve 109 to overcome the force holding the bottle top 103 to the bottle 101, lest the rotation of the cover 121 move the entire assembly without flexing the spring 115.

Since the sleeve 109 can move freely within the cover 121, when not engaged by the engagement mechanism in the drive slot, once the BTA is removed from the bottle 101, the energy stored in the leaf spring 115 will be released and the sleeve 109 can rotate back to an initial position. In this example, when the top 103 is being returned to the bottle 101, a second engagement mechanism engages drive tab 111 almost immediately, preventing flexing of the leaf spring 115 in the opposite direction, and causing the sleeve 109 to rotate in concert with the cover 121. This prevents activation of the audio playback when the BTA is being used to close a bottle 101. Of course, sufficient latitude could be given within the drive slot 113 such that the second engagement mechanism didn't engage the drive tab 111 until the leaf spring 115 had flexed upon closing, if it was desired to play the audio upon both opening and closing the bottle.

In this example, to provide audio playback, a printed circuit board (PCB) 117 and a speaker 119 are provided as part of the cover assembly 121. Rotation of the BTA causes actuation of a mechanical device that closes a circuit on the PCB 117 providing audio playback through the speaker 121. Although one form of rotation-based actuation has been discussed herein, one of ordinary skill in the art will understand that simple mechanical parts and principles can be replaced by similar or equivalent parts and principles to provide activation of the PCB upon rotation using a variety of configurations.

Figure 2:
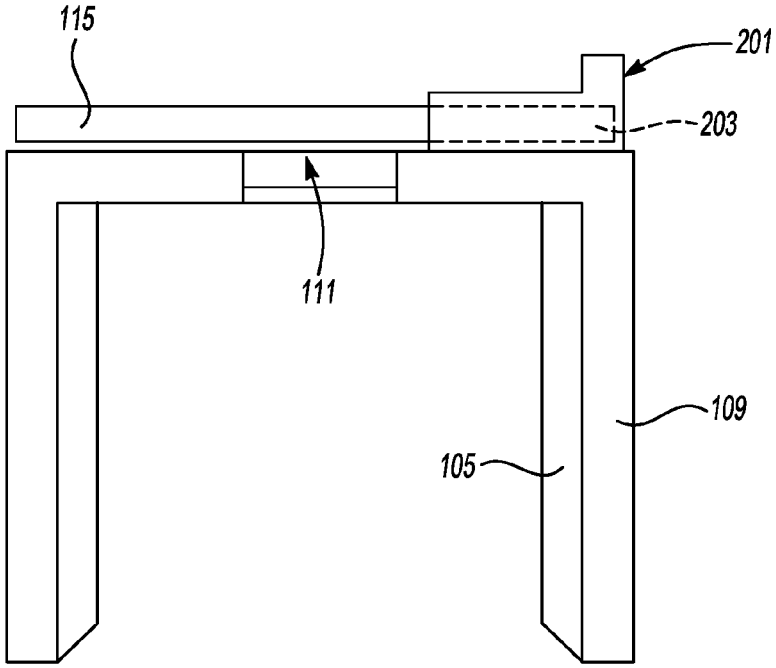
FIG. 2 is an enlarged side view of a sleeve component of the sound producing bottle cap accessory of FIG. 1.

FIG. 2 shows an illustrative example of a sleeve component of a sound producing bottle cap accessory. In this illustrative example, the sleeve 109 is shown in cross section. Again, although this particular sleeve is suitable for practicing the illustrative embodiments, mechanical replacements will be understood by those skilled in the art and are similarly considered to be within the scope of the illustrative embodiments.

In this embodiment, in order to firmly grip a bottle top, the sleeve has interior components comprising a plurality of crush ribs 105. The crush ribs are comprised of a material sufficiently malleable to compress under force from a bottle top about which the inner sleeve is placed. They are resilient enough, however, at least when compressed, to retain the bottle top in a manner such that rotation of at least the sleeve causes the bottle top to rotate in concert.

In another embodiment, a friction inducing rubber or other gripping agent may be provided to the sleeve or inner shell. This rubber may engage the bottle top when rotated, but have sufficient flexibility to release the bottle top when rotation is complete, or upon sufficient upward force from a user. This can allow a BTA to be removably attached to a variety of bottles and used repeatedly when a bottle's contents are emptied.

Also shown in FIG. 2 is a leaf spring 115. In this example, the leaf spring is engaged by the sleeve at retention portion 203. As the BTA is rotated by a user, the cover or outer shell 121 will rotate, for at least some period of time, with respect to the sleeve. The leaf spring is engaged by both the sleeve and cover, and will store energy as this rotation occurs. Once the top is removed from the bottle, this energy can be released as the spring returns to its original shape, causing rotation of the sleeve with respect to the cover. This rotation can move the actuator 201 out of a position where it completes a circuit, preventing repetitive playback of sound. Even if the actuator is moved out of a position where it completes a circuit, the sound playback may continue for a period of time until a desired sound playback has been completed.

In this example, the actuator 201 is a protrusion provided on top of spring retention portion 203. Rotating the cover with respect to the sleeve 109 will cause the actuator 201 to push a flexible contact into contact with a contact pad, completing a circuit. Once the actuator is moved back out of position by the release of energy in the leaf spring 115, the flexible contact can return to a position wherein it does not contact the contact pad.

In another illustrative example, the actuator may be a switch, movable by rotation of the cover between an on and off position. Rotation of the cover in one direction may move the switch into an on position, causing activation of a circuit. Even though turned "on," the circuit may only play one cycle of a first sound before ceasing playback. Rotation of the cover in the other direction may move the switch into an off position (or second position, causing a second sound to play), placing the switch back in a state to play the first sound (voice, music, noise, etc.) when the original rotation is again performed.

Various mechanical replacements of the actuator are considered to be within the scope of this invention, whether provided on the sleeve or interior component, on the cover or exterior component, or provided in a space formed between the sleeve and cover.

Figure 3:
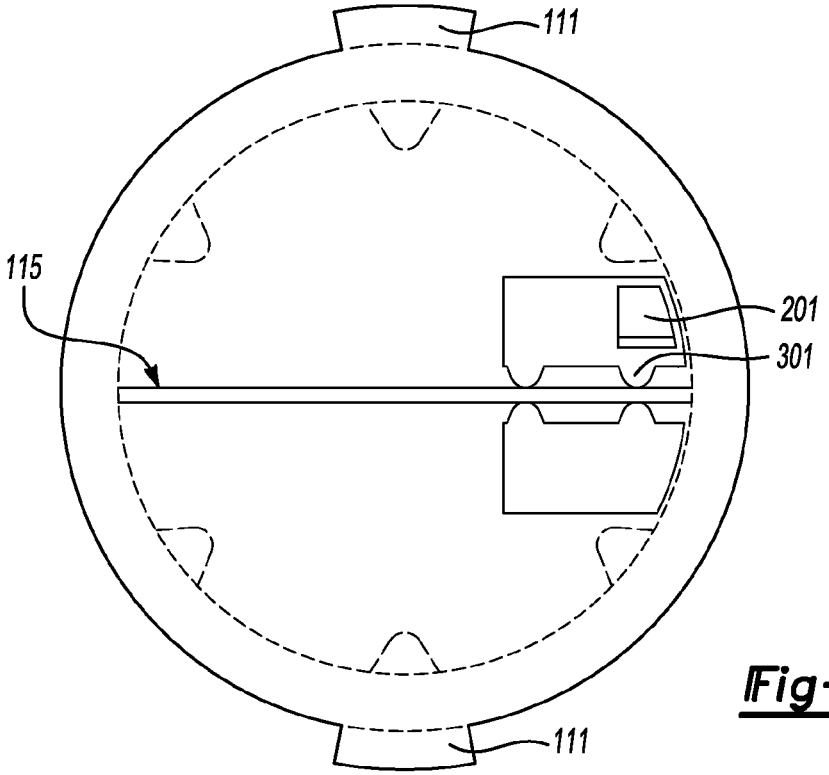
FIG. 3 is a top view of an illustrative example of the sleeve component of FIG. 2.

FIG. 3 shows an illustrative example of a top view of the sleeve component of FIG. 2. From this perspective, it can be seen that the leaf spring 115 is engaged by ribs 301 of the retention portion 201, holding the spring relatively in place with respect to the sleeve.

Additionally, a view of the drive tabs 111 is provided. These drive tabs 111 engage drive slots in the cover, movably attaching the sleeve to an interior portion of the cover. Since the drive slots, in this example, are longer than a length of the drive tabs 111, the cover can rotate for a period of time with respect to the sleeve before the drive tabs 111 reach the closed end of their respective drive slots.

Once the cover has been rotated to a sufficient point where the drive tabs are engaged by the end of the drive slot (or other suitable engagement mechanism), the rotational force applied to the cover is transferred to the sleeve through the drive tabs. Since the drive tabs cannot move any further within the drive slots, the sleeve is caused to rotate in concert with the cover, and, accordingly, the bottle top is caused to rotate in concert as well. Since the bottle top is retained by the grip of the sleeve, in this case crush ribs 105, rotation of the cover will eventually cause the bottle to open or close.

In at least one embodiment, the "starting" position of the BTA (i.e., when no rotational force is being applied thereto) is such that the drive tabs cannot move within the drive slots when rotational force is applied to close the bottle. In other words, the drive slots quickly engage the drive tabs, preventing contact of the actuator 201 with the flexible contact. This prevents the sound from being played when the bottle is being closed.

Figure 4A:
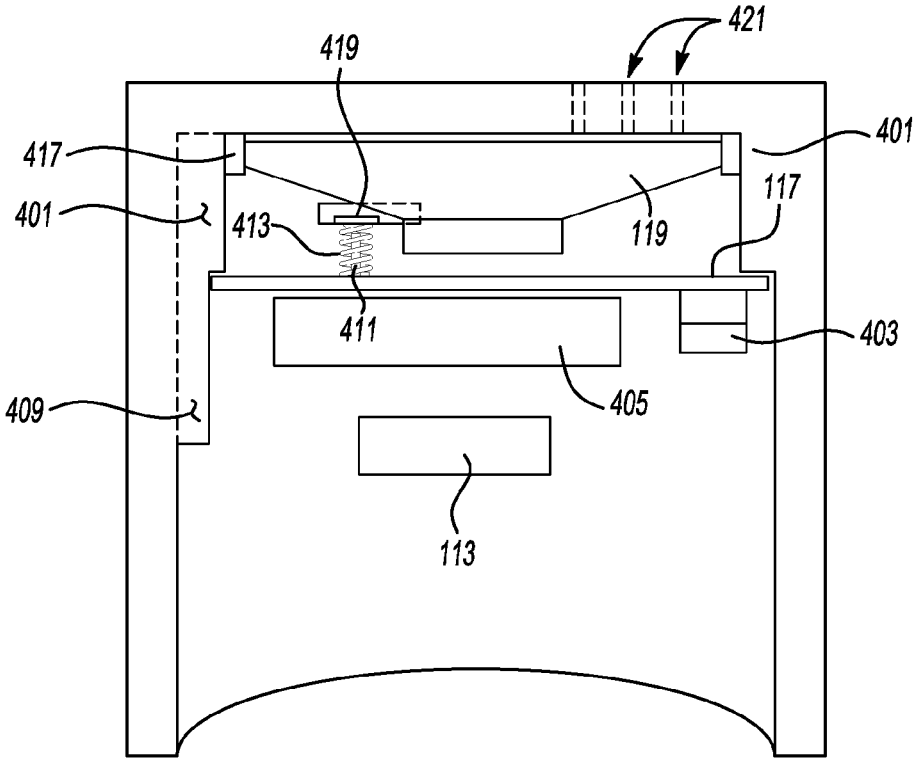
FIG. 4A is a cross section view of an illustrative example of a cover assembly, of the sound producing bottle cap accessory of FIG. 1.

FIG. 4A shows an illustrative example of a cover assembly, in cross section, of a sound producing bottle cap accessory. In this illustrative example, the speaker 119 and PCB 117 are provided as part of the cover assembly. Spacing rings 401 or other suitable replacements hold the PCB 117 a sufficient distance from the speaker 119. A small index tab 417 may hold the speaker in place.

Included with the PCB 117, in this example, is a contactor 403 that presses into a contact pad when pushed into position by the actuator. This completes a circuit, causing the PCB to output sound through the speaker 119. A battery 405, such as, but not limited to, a 3V lithium battery, is also provided to power the circuit(s) and the speaker. As previously noted, completion of the circuit through the contact of the contactor 403 with the contact pad may cause a sound to be played for a desired duration, even if the contact is broken. For example, without limitation, a clip of music may be played in its entirety, or a pre-recorded message may be played.

The cover also includes one or more drive slots 113, that correspond to drive tabs provided on the sleeve. The drive tabs fit into the drive slots 113, and can move laterally to some degree within the drive slots 113. The length of the drive slot 113 determines the degree of lateral movement, before the end of the drive slot 113 engages the drive tab. This allows the cover 121 to rotate to some degree with respect to the sleeve, at least in one direction, as rotational force is applied to the cover 121.

In this embodiment, the leaf spring causes the sleeve to rotate with respect to the cover when the bottle top is removed from the bottle. In order to cause this, in this example, the leaf spring must store some degree of energy as the bottle is opened. The cover engages an end of the leaf spring at spring tab 409. As the cover rotates with respect to the sleeve, the leaf spring is flexed, storing energy. Once the BTA is removed from the bottle (along with the bottle top), this energy is released, returning the BTA to a "resting" state. Of course, other flexible, resilient devices, such as, but not limited to, flexible plastics, coiled springs, etc., could be used in place of a leaf spring to provide the same effect.

In this example, the speaker 119 is connected to the PCB 117 by two wire posts 415 soldered to the PCB 117, which contact two springs 416 extending over the posts 415 and in contact with the posts 415. The springs 416 are made of electrically conductive material, and contact two speaker contacts 419 when the cover is assembled, providing an electrical connection between the speaker 119 and the PCB 117. Other suitable methods of connecting the speaker to the PCB may also be employed and are within the scope of the invention.

Figure 4B:
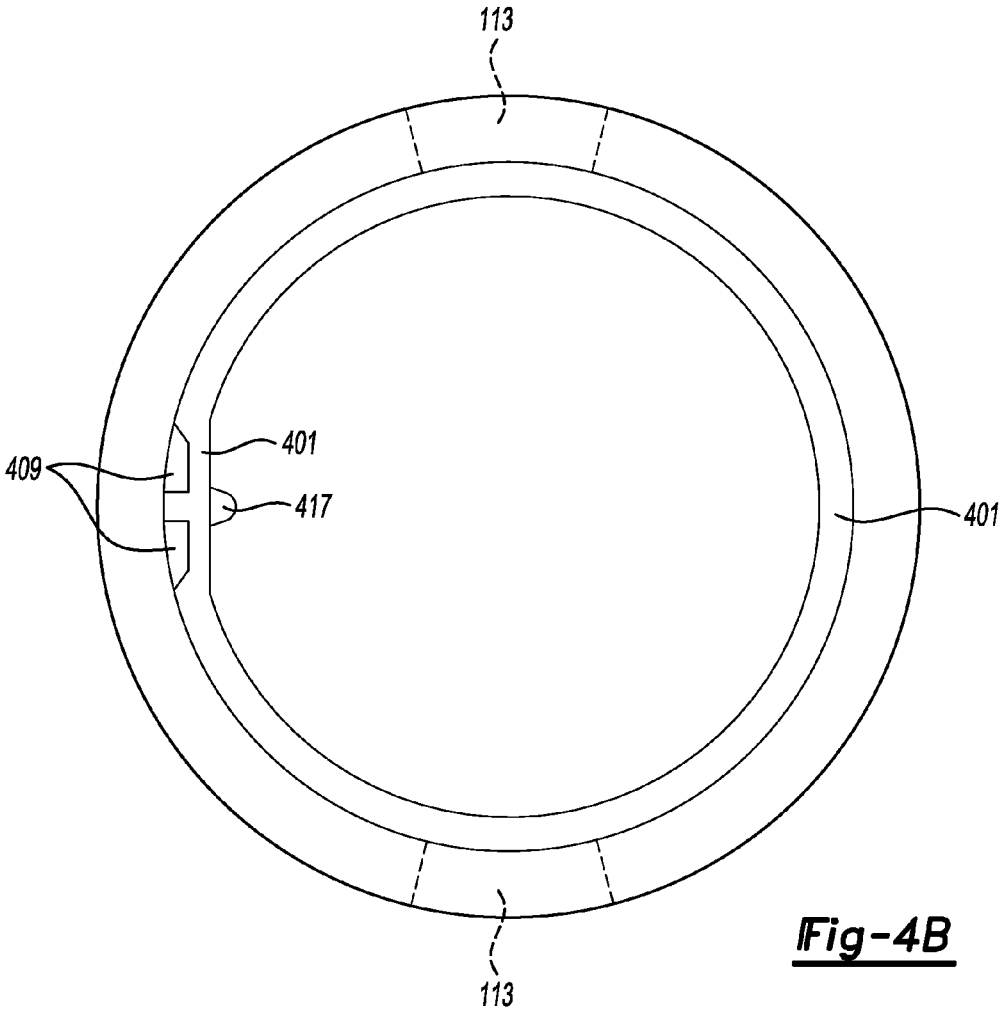
FIG. 4B is a bottom view of the cover assembly of FIG. 4.

FIG. 4B shows a bottom view of the cover assembly of FIG. 4. From this view, the spacing ring 401 and index tab 417 are visible. The placement of the index tab, in this example, may be used to align the speaker such that speaker contacts come in contact with the springs mounted over the posts affixed to the PCB. This allows, in this example, solderless connection of the speaker to the springs as the cover is assembled.

The spring tabs 409 are also visible in this view. In the detent between the tabs 409, an end of the leaf spring can be placed, engaging the leaf spring with the cover such that the spring will flex as the cover is rotated with respect to the sleeve.

Figure 5:
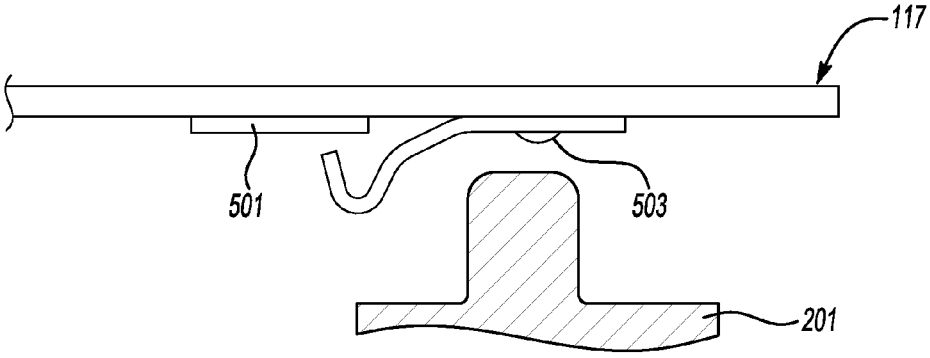
FIG. 5 is an enlarged section view of an illustrative example of an actuation component of the sound producing bottle cap accessory of FIG. 1.

FIG. 5 shows an illustrative example of an actuation component of a sound producing bottle cap accessory. In this example, as previously noted, the actuator 201 is a protrusion fixedly attached to the sleeve. The PCB 117, contact pad 501 and contactor 503 are fixedly attached to the cover.

When the sleeve is inserted into a hollow interior portion of the cover, the actuator 201 is raised to sufficient height to close the contactor 503 against the contact pad 501 if the actuator 201 and contactor 503 are brought into contact. This contact can be achieved by the rotation of the cover about the sleeve.

Since the PCB 117, contactor 503 and contact pad 501 are fixedly attached to the cover, rotation of the cover also causes rotation of the components attached thereto. As the PCB 117 rotates, it brings the contactor 503 into contact with the actuator 201. Since the actuator 201 rises higher than the resting depth of the contactor 503, and because the contactor 503 is made from flexible material, while the actuator 201 is relatively resilient, at least by comparison, contact between the two causes the actuator 201 to push the contactor 503 into contact with the contact pad 501.

Contact between the contactor 503 and the contact pad 501 causes completion of an activation circuit on the PCB 117, and this activates the playback of prerecorded audio. When the leaf spring releases energy stored therein by the movement of the cover relational to the sleeve, it springs the sleeve back into a resting state, wherein the actuator 201 is no longer in contact with the contactor 503. Since the contactor 503 is resiliently deformable, it springs back into its resting position, no longer in contact with the contact pad 501. This opens the circuit and allows it to reset so it can be activated again the next time the bottle is opened, for example.

The illustrative embodiment described in some detail in FIGS. 1-5 may be placed on a bottle after the bottle has been filled and capped by a normal capping process. A simple downward press on the cover will secure the BTA over the bottle cover via the crush ribs. In other embodiments, the BTA may be secured by, for example, flexible rubber, and may be removable once the bottle has been recapped. Or the BTA may include threading such that it actually comprises the bottle cap itself.

Rotation of the exterior cover relative to an interior component provides both the actuation of the sound producing PCB and the energy stored in the spring to return the BTA to a resting state when the bottle top is removed. If, however, a switch is used for PCB actuation, the resilient spring may be omitted entirely, if desired.

Other suitable mechanical replacements for the elements comprising the BTA may be made without moving beyond the scope of the invention. Mere replacement of one spring for another, for example, or one actuator for another, will not take an embodiment outside the contemplated scope of the invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus comprising:

an outer shell, comprising a cylindrical hollow interior and an engagement portion;

an inner shell, comprising a cylindrical exterior smaller than the cylindrical hollow interior of the outer shell and a hollow threaded interior for threaded engagement with a bottle top;

wherein the inner shell is movably attached to the cylindrical hollow interior of the outer shell, such that rotation of the outer shell causes the outer shell to rotate with respect to the inner shell for a limited range before the engagement portion of the outer shell engages the inner shell, whereby the inner shell is caused to rotate in concert with the outer shell;

a printed circuit board, provided between the cylindrical hollow interior of the outer shell and the cylindrical exterior of the inner shell providing a circuit;

a contact switch, including a compressible contactor portion and a contact pad, both affixed to the same one of either the inner or outer shell;

an actuator, fixedly attached to whichever of the inner or outer shell the contactor portion and contact pad are not affixed to, wherein the rotation of the outer shell relative to the inner shell causes the actuator to compress the compressible contactor portion into contact with the contact pad as either the compressible contactor portion and the contact pad are rotated towards the actuator or the actuator is rotated towards the compressible contactor portion and the contact pad, thereby activating the circuit;

a resilient, flexible spring, engaged by both the inner and outer shell, wherein the rotation of the outer shell relative to the inner shell causes the spring to deform, storing energy, and wherein the energy is sufficient to cause rotation of the inner shell relative to the outer shell, moving the actuator to a position wherein the compressible contactor portion is uncompressed, thereby deactivating the circuit, once the bottle top has been removed from a bottle and the energy is released; and a speaker, connected to the printed circuit board and operable to play sound when the circuit is activated.

2. The apparatus of claim 1, wherein the hollow threaded interior of the inner shell is cylindrical.

3. The apparatus of claim 1, wherein the spring comprises a leaf spring.

4. The apparatus of claim 3, wherein the leaf spring is fixedly attached to the inner shell and engaged by the outer shell, such that the rotation of the outer shell relative to the inner shell causes the spring to flex.

5. The apparatus of claim 1, further comprising a plurality of posts connecting the speaker to the printed circuit board.

6. The apparatus of claim 1, wherein the outer shell further includes one or more apertures extending through an exterior surface thereof to an interior hollow portion thereof containing the speaker, such that sound produced by the speaker travels through the one or more apertures.

7. The apparatus of claim 6, wherein the interior hollow portion is defined by a clearance between a top portion of the interior of the outer shell and an interior bottom portion of the cylindrical hollow interior of the outer shell.

8. The apparatus of claim 1, wherein the hollow threaded interior of the inner shell comprises a plurality of crush ribs, having sufficient malleability to deform when the hollow threaded interior is placed on the bottle top for threaded engagement with the bottle top and the crush ribs have sufficient resiliency during the threaded engagement with the bottle top such that rotation of the inner shell causes rotation of the bottle top.

* * * * *